US011325796B2

(12) United States Patent
Noguchi et al.

(10) Patent No.: US 11,325,796 B2
(45) Date of Patent: May 10, 2022

(54) SHEET FEEDING DEVICE AND IMAGE FORMING DEVICE

(71) Applicant: SHARP KABUSHIKI KAISHA, Sakai (JP)

(72) Inventors: Tadashi Noguchi, Sakai (JP); Kohji Aoki, Sakai (JP); Tsuyoshi Shibayama, Sakai (JP); Masaharu Kimura, Sakai (JP); Haruhisa Furumoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 199 days.

(21) Appl. No.: 16/548,017

(22) Filed: Aug. 22, 2019

(65) Prior Publication Data

US 2020/0062519 A1 Feb. 27, 2020

(30) Foreign Application Priority Data

Aug. 27, 2018 (JP) ..... JP2018-158274

(51) Int. Cl.
*B65H 1/26* (2006.01)
*B65H 1/24* (2006.01)

(52) U.S. Cl.
CPC ..... *B65H 1/24* (2013.01); *B65H 1/266* (2013.01); *B65H 2405/11163* (2013.01); *B65H 2405/11171* (2013.01); *B65H 2405/11425* (2013.01); *B65H 2511/12* (2013.01)

(58) Field of Classification Search
CPC ..... B65H 9/08; B65H 2406/11163; B65H 2405/11171; B65H 2405/11425; B65H 2511/12
See application file for complete search history.

(56) References Cited

U.S. PATENT DOCUMENTS 6,834,852 B2 * 12/2004 Smith ..... B41J 13/106 271/207
7,976,017 B2 * 7/2011 Shiohara ..... B65H 1/266 271/171
9,656,818 B2 * 5/2017 Furuichi ..... B65H 3/48
2002/0017754 A1 2/2002 Kang
2004/0247349 A1 12/2004 Takahashi et al.
2011/0221121 A1 9/2011 Hamasaki et al.
2013/0183075 A1 * 7/2013 Kim ..... B65H 16/028 400/619

(Continued)

FOREIGN PATENT DOCUMENTS

JP H07-089624 A 4/1995
JP H10-258946 A 9/1998

(Continued)

*Primary Examiner* — Howard J Sanders
(74) *Attorney, Agent, or Firm* — ScienBiziP, P.C.

(57) ABSTRACT

A sheet feeding device includes a sheet feeding cassette, which is detachable with respect to a sheet feeding cassette mounting portion provided on an image forming device body. The sheet feeding cassette includes a storage portion that stores a paper sheet, a first regulator provided on a bottom portion of the storage portion that regulates the position of a paper sheet, and a movable placement plate that upwardly pushes a paper sheet stored in the storage portion. The movable placement plate includes a second regulator that regulates the position of a paper sheet having a different size to the size of a paper sheet that can be regulated by the first regulator.

7 Claims, 8 Drawing Sheets

(56) References Cited

U.S. PATENT DOCUMENTS

| | | | | |
|---|---|---|---|---|
| 2017/0185025 | A1* | 6/2017 | Wakabayashi | G03G 15/6564 |
| 2018/0373190 | A1* | 12/2018 | Tashiro | B65H 1/04 |
| 2019/0030920 | A1* | 1/2019 | Mori | B65H 3/44 |

FOREIGN PATENT DOCUMENTS

| | | | |
|---|---|---|---|
| JP | H11-059925 | A | 3/1999 |
| JP | 2004-315230 | A | 11/2004 |
| JP | 2008-081262 | A | 4/2008 |

* cited by examiner

SHEET FEEDING DEVICE AND IMAGE FORMING DEVICE

BACKGROUND OF THE INVENTION

Field of the Invention

The present invention relates to a sheet feeding device provided with a sheet feeding cassette, and an image forming device provided with a sheet feeding device.

Description of the Background Art

A sheet feeding device provided with a sheet feeding cassette is known as a sheet feeding device provided in an image forming device. A sheet feeding cassette can be switched between a mounted state, in which the sheet feeding cassette is mounted to a sheet feeding cassette mounting portion on an image forming device body, and a pulled-out state, in which the sheet feeding cassette has been pulled out from the sheet feeding cassette mounting portion. In the mounted state, paper sheets can be fed from the sheet feeding cassette to an image forming device body. Further, in the pulled-out state, paper sheets can be replenished or replaced.

A sheet feeding cassette is provided with a regulator that regulates the position of a stored paper sheet, and a movable placement plate that upwardly pushes the stored paper sheet to make contact with a pickup roller (for example, see Japanese Unexamined Patent Application Publication No. 2004-315230). The regulator is a member that regulates the position of a side end portions and a rear end portion of the paper sheet. The regulator is movably configured so that changes in the paper sheet size can be supported. An opening is formed in the movable placement plate that corresponds to the movement range of the regulator. The opening is formed such that the regulator and the movable placement plate do not interfere with each other.

However, even though the conventional regulator described above is movably configured so that changes in the paper sheet size can be supported, there are limitations in the paper sheet sizes that can be supported. For example, even when paper sheet sizes such as A4 and B3 are supported, there are some cases where smaller paper sheet sizes such as A6 and postcard size cannot be supported. This is because it is necessary to broaden the movement range of the regulator to support a wide variety of paper sheet sizes, and because the opening formed in the movable placement plate must be correspondingly enlarged.

If the opening formed in the movable placement plate is enlarged, the width of the section on which a paper sheet is placed becomes narrower, and there is a concern that the paper sheet may no longer be stably supported when a large paper sheet is placed on the movable placement plate. Furthermore, to inhibit decreases in the strength of the movable placement plate resulting from the opening being enlarged, the need also arises to change the structure and material of the movable placement plate. Consequently, the conventional regulator described above is limited in terms of the paper sheet sizes that can be supported.

Japanese Unexamined Patent Application Publication No. H11-59925 discloses a technique of installing a separate member for small sizes on the movable placement plate to support small paper sheet sizes such as postcard size. However, in the technique of Japanese Unexamined Patent Application Publication No. H11-59925, it is necessary to take the trouble of attaching the separate member to the movable placement plate when a small paper sheet size is being used, and removing the separate member when a small paper sheet size is not being used. Furthermore, when the separate member for small sizes is in use, a location for accommodating the separate member is also required.

An object of the present invention is to provide a sheet feeding device and an image forming device that are capable of stably supporting a paper sheet by means of a movable placement plate, and further, are capable of supporting various paper sheet sizes without taking the trouble of attaching and detaching a separate member.

SUMMARY OF THE INVENTION

A sheet feeding device of the present invention includes a sheet feeding cassette, which is detachable with respect to a sheet feeding cassette mounting portion provided on an image forming device body, wherein the sheet feeding cassette includes a storage portion that stores a paper sheet, a first regulator provided on a bottom portion of the storage portion and regulates the position of a paper sheet, and a movable placement plate that upwardly pushes a paper sheet stored in the storage portion, and the movable placement plate includes a second regulator that regulates the position of a paper sheet having a different size to a paper sheet size that can be regulated by the first regulator (first configuration).

According to the above configuration, the movable placement plate includes a second regulator, and the second regulator regulates the position of a paper sheet having a different size to the paper sheet size that can be regulated by the first regulator. Consequently, a paper sheet can be stably supported by the movable placement plate, and various sheet sizes can also be supported without taking the trouble of attaching and detaching a separate member.

In the first configuration above, the second regulator may be capable of being accommodated in the movable placement plate (second configuration).

According to the above configuration, the second regulator can be accommodated in the movable placement plate. Consequently, the second regulator can be accommodated in the movable placement plate when not being used, and it is not necessary to prepare a separate accommodation location.

In the first or second configurations above, the second regulator may be capable of switching postures between a standing posture, in which the second regulator stands upright with respect to an upper surface of the movable placement plate, and an accommodation posture, in which the second regulator is accommodated in the movable placement plate (third configuration).

According to the above configuration, the second regulator is capable of switching postures between a standing posture and an accommodation posture. The second regulator can be switched to the standing posture when the second regulator is being used, and the second regulator can be switched to the accommodation posture when the second regulator is not being used and the first regulator is being used. Consequently, it is possible to easily switch the posture of the first regulator according to which of the first regulator and the second regulator is being used.

In the second or third configurations above, the movable placement plate may include an accommodation portion that accommodates the second regulator (fourth configuration).

According to the above configuration, the movable placement plate includes an accommodation portion that accommodates the second regulator. Consequently, the second regulator is accommodated in the accommodation portion when not being used, and can be prevented from obstructing the first regulator from being used.

In any one of the first to fourth configurations above, the second regulator, given a sheet feeding direction which is a direction in which a paper sheet stored in the sheet feeding cassette is fed, may include a side end regulator that regulates the position of a side end portion, the side end portion being an end portion among the end portions of a paper sheet stored in the storage portion which is parallel to the sheet feeding direction, and a rear end regulator that regulates the position of a rear end portion, the rear end portion being an end portion among the end portions of a paper sheet stored in the storage portion which is on a rear side with respect to the sheet feeding direction (fifth configuration).

According to the above configuration, the second regulator includes a side end regulator that regulates the position of a side end portion, and a rear end regulator that regulates the position of a rear end portion. Consequently, the position of a paper sheet can be regulated by the second regulator.

In the fifth configuration above, the side end regulator and the rear end regulator may be integrally formed (sixth configuration).

According to the above configuration, the side end regulator and the rear end regulator of the second regulator are integrally formed. Consequently, the positions of the side end regulator and the rear end regulator can be stabilized.

In the fifth configuration above, the side end regulator and the rear end regulator may be individually formed (seventh configuration).

According to the above configuration, the side end regulator and the rear end regulator of the second regulator are individually formed. Consequently, the positions of the side end regulator and the rear end regulator can be individually set.

In any one of the first to seventh configurations above, the second regulator may have a position which is capable of being adjusted to correspond to a paper sheet size (eighth configuration).

According to the above configuration, the second regulator has a position which is capable of being adjusted to correspond to a paper sheet size. Consequently, the second regulator is capable of supporting various paper sheet sizes.

In any one of the first to eighth configurations above, a paper sheet detector that detects which of the first regulator and the second regulator is being used to regulate the position of a paper sheet, and a paper sheet size determinator that determines a paper sheet size based on a detection result of the paper sheet detector may be further included (ninth configuration).

According to the above configuration, the paper sheet size determinator determines the paper sheet size based on a detection result of the paper sheet detector. Consequently, the paper sheet size can be easily determined.

The image forming device according to the present invention includes a sheet feeding device having any one of the first to ninth configurations above (tenth configuration).

According to the above configuration, the movable placement plate includes a second regulator, and the second regulator regulates the position of a paper sheet having a different size to the paper sheet size that can be regulated by the first regulator. Consequently, a paper sheet can be stably supported by the movable placement plate, and various sheet sizes can also be supported without taking the trouble of attaching and detaching a separate member.

According to the sheet feeding device and the image forming device of the present invention, a paper sheet can be stably supported by a movable placement plate, and various sheet sizes can also be supported without taking the trouble of attaching and detaching a separate member.

DESCRIPTION OF THE PREFERRED EMBODIMENTS

First Embodiment

Figure 1:
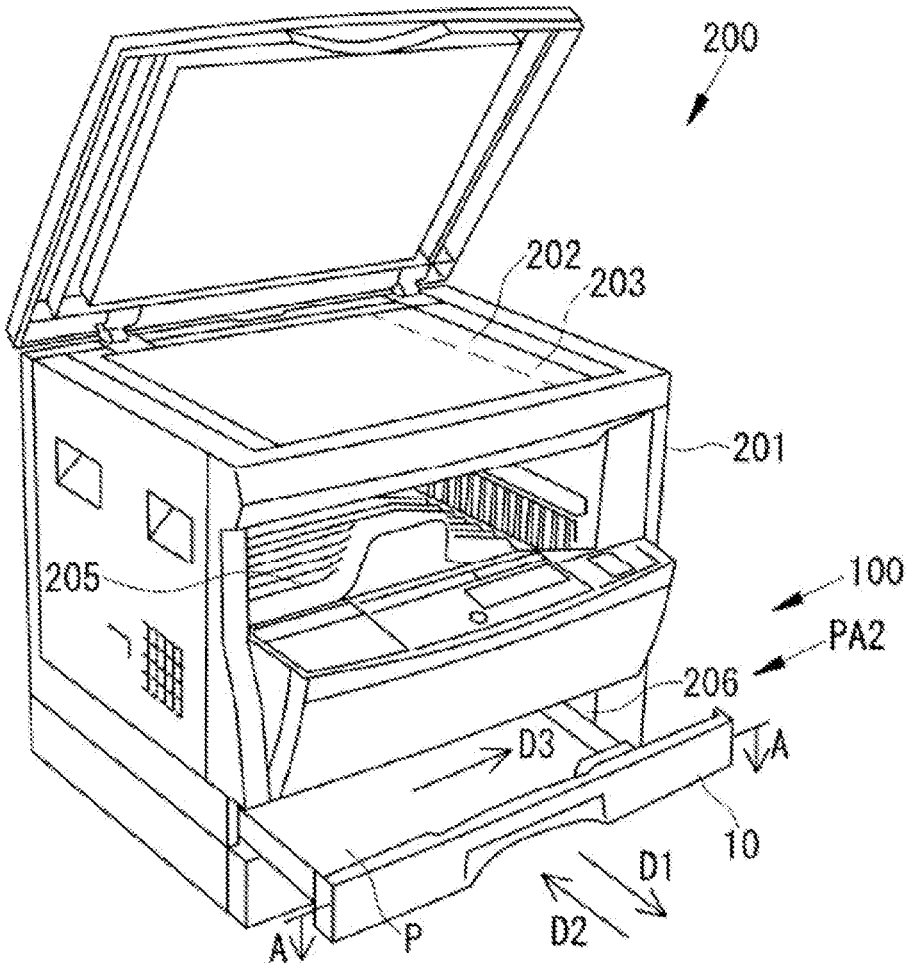
FIG. 1 is a perspective view showing an overall configuration of an image forming device to which a sheet feeding device according to a first embodiment is applied.

Hereinafter, embodiments of the present invention will be described based on the drawings. FIG. 1 is a perspective view showing an overall configuration of an image forming device 200 to which a sheet feeding device 100 according to a first embodiment is applied. The image forming device 200 includes an image forming device body 201, a document table 202, a scanner 203, a paper discharge tray 205, a sheet feeding cassette mounting portion 206, and a sheet feeding device 100.

The image forming device body 201 is the body section of the image forming device 200. The document table 202 is a glass body installed on an upper surface of the image forming device body 201. The scanner 203 is provided below the document table 202, and reads an image of a document placed on the document table 202. An image former (not shown) is provided inside the image forming device body 201. The image data read by the scanner 203 is input to the image former, and an image based on the image data is formed on the surface of a paper sheet by the electrophotographic image forming method. The paper discharge tray 205 is installed to the upper center of the image forming device body 201 (a position below the scanner 203), and discharges the paper sheet on which the image is formed.

The sheet feeding device 100 of the present embodiment is provided below the paper discharge tray 205. The sheet feeding device 100 is provided with two sheet feeding cassette mounting portions 206 on an upper and lower level. A sheet feeding cassette 10 constituting the sheet feeding device 100 of the present invention is mounted to each of the sheet feeding cassette mounting portions 206.

The sheet feeding cassette 10 can be switched between a mounted state and a pulled-out state. In the mounted state, the sheet feeding cassette 10 is mounted to the sheet feeding cassette mounting portion 206. In the pulled-out state, the sheet feeding cassette 10 has been pulled out from the sheet feeding cassette mounting portion 206. The sheet feeding cassette 10 shown in FIG. 1 is in the pulled-out state, and can be switched to the mounted state by pushing the sheet feeding cassette 10 into the sheet feeding cassette mounting portion 206 from the front side toward the back side in the drawing.

Figure 2:
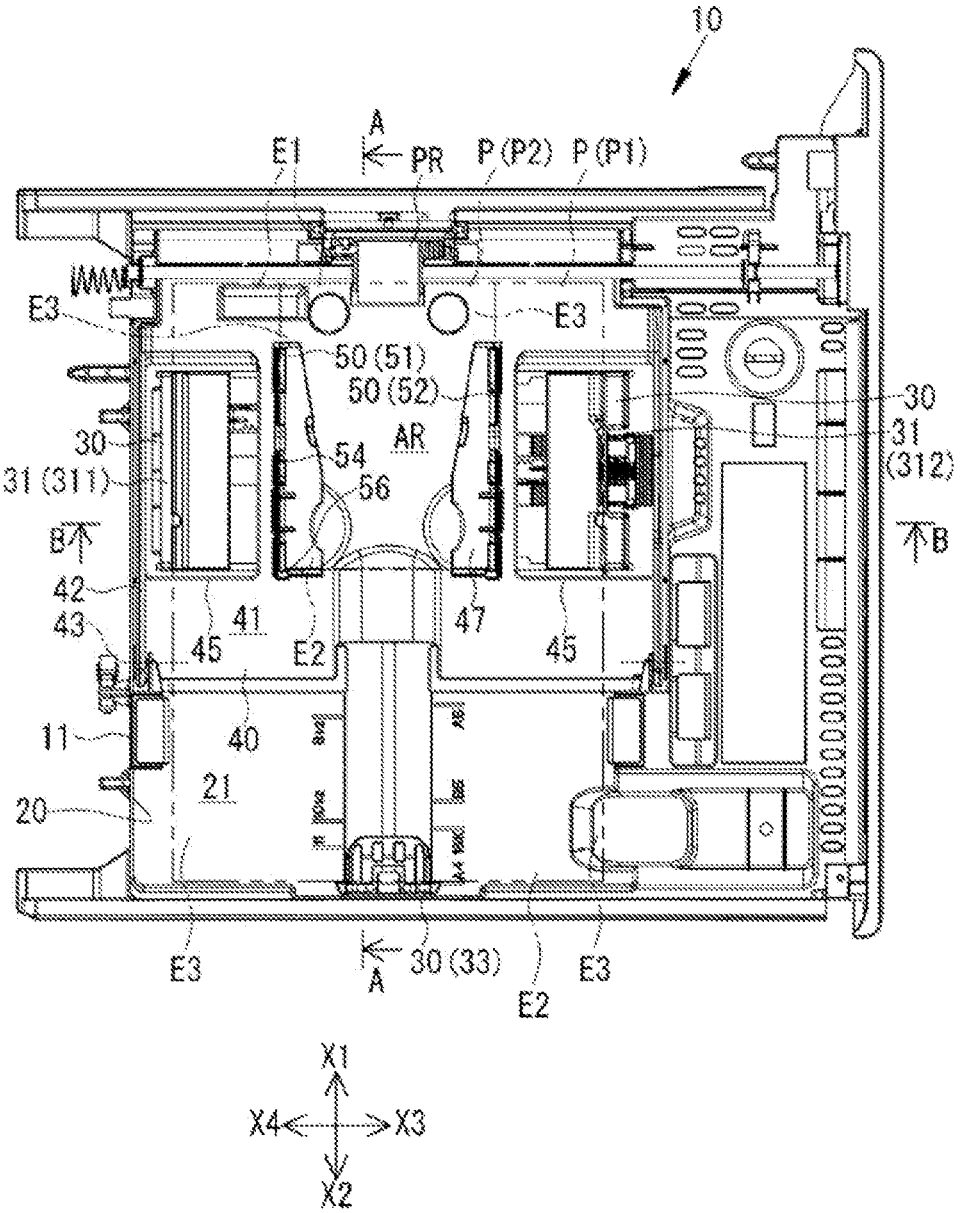
FIG. 2 is a plan view of a sheet feeding cassette.

Next, the sheet feeding cassette 10 constituting the sheet feeding device 100 will be described in detail. FIG. 2 is a plan view of a sheet feeding cassette 10. As shown in FIG. 2, the sheet feeding cassette 10 includes a sheet feeding cassette body 11, a storage portion 20, a first regulator 30, and a movable placement plate 40. The movable placement plate 40 is provided with a second regulator 50.

The sheet feeding cassette body 11 is a section that forms the base of the sheet feeding cassette 10.

The storage portion 20 is formed inside the sheet feeding cassette body 11. A paper sheet P (P1 or P2) is stored in the storage portion 20. In the mounted state, the paper sheet P stored in the storage portion 20 is pulled out by a pickup roller PR, and is transported to a sheet transport path (not shown) by a paper sheet feeding roller (not shown). An image is formed on the surface of the paper sheet P transported to the sheet transport path in the image former. In the mounted state, the direction in which the paper sheet P stored in the sheet feeding cassette 10 is fed is referred to as a first direction X1. The direction opposite to the first direction X1 is referred to as a second direction X2. Furthermore, one of the directions orthogonal to the first direction X1 and the second direction X2 in the horizontal direction is referred to as a third direction X3. The direction opposite to the third direction X3 is referred to as a fourth direction X4.

The position of the paper sheet P (P1, P2) stored in the storage portion 20 is regulated by the first regulator 30 or the second regulator 50 depending on the paper sheet size. It is assumed that when a paper sheet P1 is used, the position of the paper sheet P1 is regulated by the first regulator 30, and when a paper sheet P2 is used, the position of the paper sheet P2 is regulated by the second regulator 50. In the present embodiment, the size of the paper sheet P1 that can be regulated by the first regulator 30 is different to the size of the paper sheet P2 that can be regulated by the second regulator 50. Further, the size of the paper sheet P2 is smaller than the size of the paper sheet P1. For example, the size of the paper sheet P1 is A4, A3, B5, B4, and the like, and the size of the paper sheet P2 is A6, postcard size, and the like.

Among the end portions of the paper sheet P (P1, P2) stored in the storage portion 20, the end portion on the front side with respect to the first direction X1 (the rear side with respect to the second direction X2) is referred to as a front end portion E1. Furthermore, the end portion on the rear side with respect to the first direction X1 (the end portion on the front side with respect to the second direction X2) is referred to as a rear end portion E2. Moreover, among the end portions of the paper sheet P (P1, P2) stored in the storage portion 20, the end portions parallel to the first direction X1 (the end portions in the third direction X3 and the fourth direction X4) are referred to as side end portions E3.

The first regulator 30 is provided on a bottom portion 21 of the storage portion 20, and regulates the position of the paper sheet P1. The first regulator 30 includes a side end regulating member 31 and a rear end regulating member 33.

The side end regulating member 31 is a member that regulates the positions of the side end portions E3 of the paper sheet P1. The side end regulating member 31 includes a first regulating member 311 and a second regulating member 312. The first regulating member 311 and the second regulating member 312 are opposingly disposed so as to sandwich the side end portions E3 of the paper sheet P1 from both sides. The first regulating member 311 and the second regulating member 312 are respectively capable of moving in the third direction X3 and the fourth direction X4, and are configured to interlockingly move in opposite directions to each other when the spacing is adjusted according to the size of the paper sheet P1.

The rear end regulating member 33 is a member that regulates the position of the rear end portion E2 of the paper sheet P1. The rear end regulating member 33 is capable of moving in the first direction X1 and the second direction X2, and has a position which can be adjusted according to the size of the paper sheet P1.

The movable placement plate 40 is a member that upwardly pushes the front end portion E1 of the paper sheet P (P1, P2) stored in the storage portion 20 to make contact with the pickup roller PR. The movable placement plate 40 includes a placement portion 41 and a side wall portion 42.

The placement portion 41 is a section on which the paper sheet P (P1, P2) is placed. The placement portion 41 is disposed above the bottom portion 21. The placement portion 41 is provided with an opening 45 and a second regulator 50.

The side wall portion 42 is standingly provided at both end portions of the placement portion 41 in the third direction X3 and the fourth direction X4. The side wall portion 42 is rotatably connected to the sheet feeding cassette body 11 by means of a support shaft 43.

The movable placement plate 40 can be rotated with respect to the sheet feeding cassette body 11. A posture in which the movable placement plate 40 is rotated with respect to the sheet feeding cassette body 11 and the front end portion E1 of the paper sheet P (P1, P2) is rotated to make contact with the pickup roller PR is referred to as a sheet feeding posture PA1 (see FIG. 3 and FIG. 7B). Furthermore, a posture in which the movable placement plate 40 is rotated so as to separate the front end portion E1 of the paper sheet P (P1, P2) from the pickup roller PR is referred to as a non-sheet feeding posture PA2 (see FIG. 7A). The movable placement plate 40 is configured to switch from the non-sheet feeding posture PA2 to the sheet feeding posture PA1 when the sheet feeding cassette 10 is mounted to the sheet feeding cassette mounting portion 206 to adopt the mounted state, and switch from the sheet feeding posture PA1 to the non-sheet feeding posture PA2 when the sheet feeding cassette 10 is pulled out from the sheet feeding cassette mounting portion 206 to adopt the pulled-out state.

The opening 45 is formed to enable the first regulating member 311 and the second regulating member 312 provided on the bottom portion 21 to be inserted through. The opening 45 is formed larger than the movable ranges of the first regulating member 311 and the second regulating member 312 so that the movable placement plate 40 does not interfere with the first regulating member 311 and the second regulating member 312.

The second regulator 50 is provided to regulate the position of the paper sheet P2, which is smaller in size than the paper sheet P1 that can be regulated by the first regulator 30. In other words, as a result of providing the second regulator 50, the paper sheet P2, which has a small size that cannot be supported by the first regulator 30, can be supported. The second regulator 50 is provided in a region AR, which is a region of the placement portion 41 of the movable placement plate 40 which is sandwiched by the opening 45.

The second regulator 50 regulates the position of the paper sheet P2 placed in the region AR of the movable placement plate 40.

The second regulator 50 includes a first regulating body 51 and a second regulating body 52. The first regulating body 51 and the second regulating body 52 have configurations which are substantially symmetrical to each other. Consequently, the first regulating body 51 is mainly explained below, and detailed explanation is omitted for the second regulating body 52.

The first regulating body 51 includes a side end regulator 54 and a rear end regulator 56. The side end regulator 54 is a section that regulates the positions of the side end portions E3 of the paper sheet P2. The rear end regulator 56 is a section that regulates the position of the rear end portion E2 of the paper sheet P2. The side end regulator 54 and the rear end regulator 56 are integrally formed. The configuration of the first regulating body 51 will be described in detail later.

Figure 3:
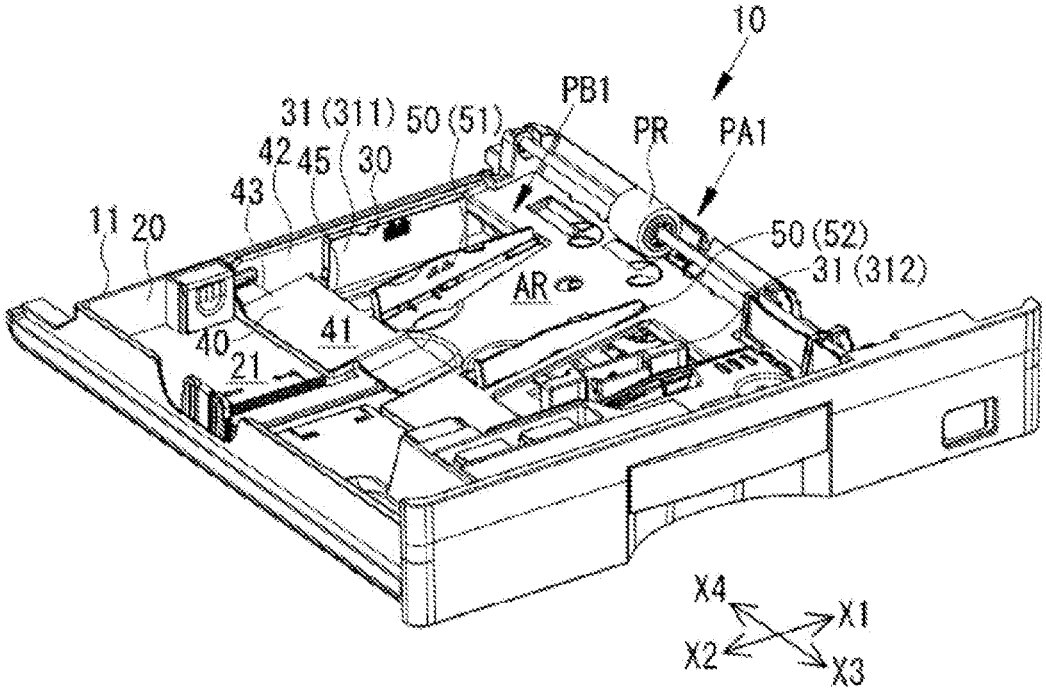
FIG. 3 is a perspective view of the sheet feeding cassette.

FIG. 3 is a perspective view of the sheet feeding cassette 10. FIG. 3 shows a state in which the movable placement plate 40 has been switched to the sheet feeding posture PA1. The first regulating body 51 is provided such that it can be raised and lowered with respect to the placement portion 41. Further, the placement portion 41 is formed having an accommodation portion 47 that accommodates the first regulating body 51 when the first regulating body 51 is in the lowered posture. A posture in which the first regulating body 51 stands upright with respect to an upper surface of the placement portion 41 is referred to as a standing posture PB1 (see FIG. 8B). A posture in which the first regulating body 51 is lowered with respect to the upper surface of the placement portion 41 and is accommodated in the accommodation portion 47 is referred to as an accommodation posture PB2 (see FIG. 8A). In the standing posture PB1, the first regulating body 51 is in a vertically standing posture with respect to the upper surface of the placement portion 41. Further, in the accommodation posture PB2, the first regulating body 51 is in an accommodation posture in the accommodation portion 47 provided on the central side of the region AR of the placement portion 41.

The posture of the first regulating body 51 is switched depending on whether the first regulating body 51 is being used or not being used. Specifically, when using the first regulating body 51 is being used, the first regulating body 51 is switched to the standing posture PB1. Further, when the first regulating body 51 is not being used, the first regulating body 51 is switched to the accommodation posture PB2. FIG. 3 shows a state in which the first regulating body 51 and the second regulating body 52 have been switched to the standing posture PB1.

Figure 4:
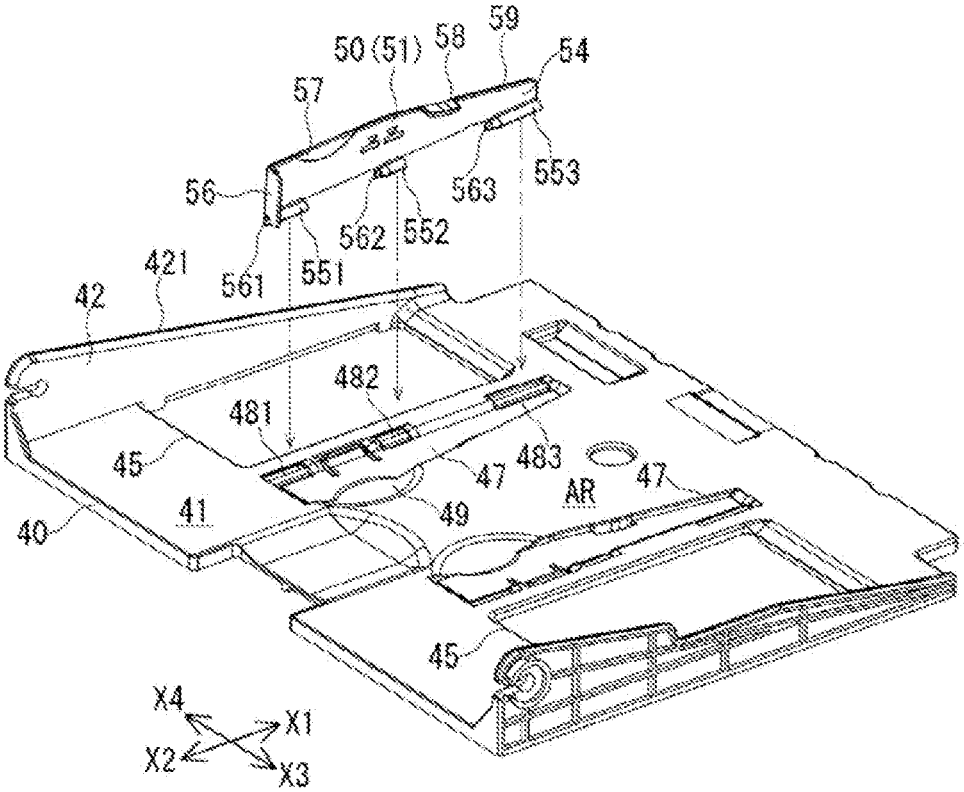
FIG. 4 is a perspective view of a movable placement plate and a second regulator.

FIG. 4 is a perspective view of the movable placement plate 40 and the second regulator 50 (first regulating body 51). As shown in FIG. 4, the side wall portion 42 of the movable placement plate 40 is formed having an inclined portion 421 on an upper end portion. The inclined portion 421 is formed to become lower toward the front with respect to the first direction X1. The inclined portion 421 is formed to inhibit the side wall portion 42 from protruding above the sheet feeding cassette body 11 when the movable placement plate 40 has been switched to the sheet feeding posture PA1 (see FIG. 3 and FIG. 7B). Consequently, interference between the sheet feeding cassette mounting portion 206 of the image forming device body 201 and the side wall portion 42 is prevented when the movable placement plate 40 has been switched to the sheet feeding posture PA1.

The accommodation portion 47 that accommodates the first regulating body 51 is formed in the placement portion 41. The accommodation portion 47 is formed by means of a concave-shaped portion which is capable of accommodation the side end regulator 54. A first shaft 481, a second shaft 482, and a third shaft 483 that support the first regulating body 51 are provided on a side portion of the accommodation portion 47. On the other hand, a first holding portion 551, a second holding portion 552, and a third holding portion 553 are provided on a lower portion of the side end regulator 54 of the first regulating body 51. The first holding portion 551, the second holding portion 552, and the third holding portion 553 rotatably hold the first shaft 481, the second shaft 482, and the third shaft 483, respectively. The first regulating body 51 is attached to the placement portion 41 such that it can be raised and lowered as a result of the first shaft 481, the second shaft 482, and the third shaft 483 being rotatably held by the first holding portion 551, the second holding portion 552, and the third holding portion 553.

Figure 6:
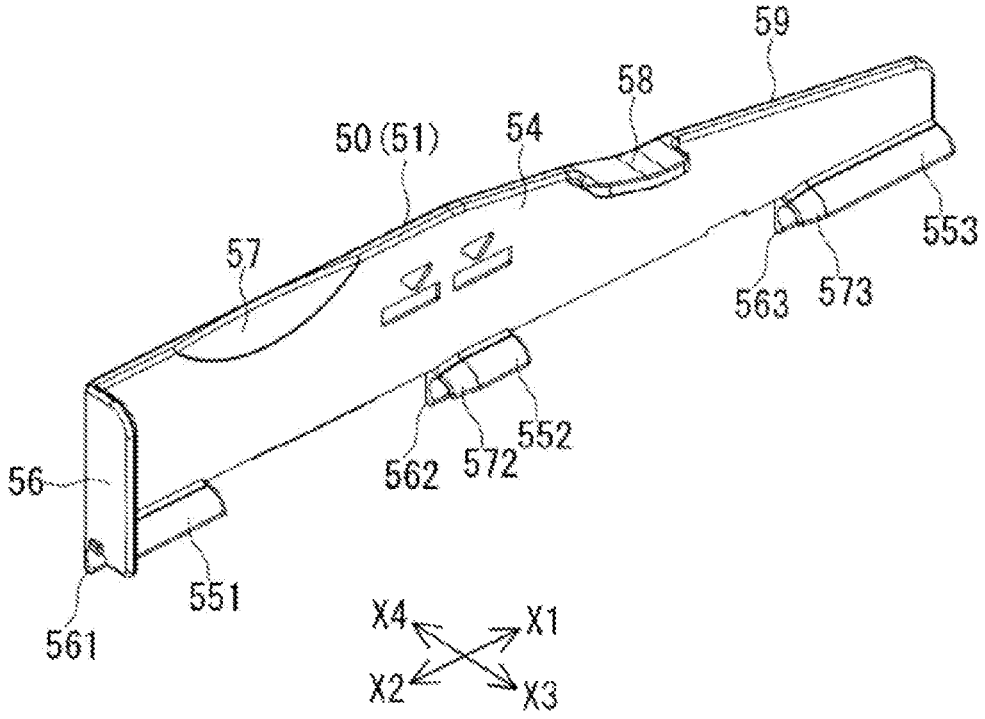
FIG. 6 is a perspective view of a first regulating body that constitutes a second regulator.

The first holding portion 551, the second holding portion 552, and the third holding portion 553 are respectively provided with abutting portions 561, 562 and 563 (see FIG. 6). When the first regulating body 51 is in the standing posture PB1, the first regulating body 51 is prevented from rotating more than 90 degrees with respect to the placement portion 41 as a result of the abutting portions 561, 562 and 563 abutting the placement portion 41.

The side end regulator 54 of the first regulating body 51 is formed having a concave portion 57, a protrusion 58, and an inclined portion 59 (see FIG. 6).

The concave portion 57 is formed to enable a user to hook a finger to raise the first regulating body 51 more easily at the time the first regulating body 51 is switched from the accommodation posture PB2 to the standing posture PB1. The concave portion 57 is formed in an edge portion of the upper end of the side end regulator 54. A concave portion 49 is formed in the placement portion 41 of the movable placement plate 40. The concave portion 49 is formed in a position that faces the concave portion 57 when the first regulating body 51 is in the accommodation posture PB2. As a result of the concave portion 57 of the first regulating body 51 and the concave portion 49 of the placement portion 41 facing each other when the first regulating body 51 is in the accommodation posture PB2, a spacing is formed between the first regulating body 51 and the accommodation portion 47 (see FIG. 8A). A user is capable of more easily hooking a finger around the edge portion of the first regulating body 51 as a result of the spacing, and the posture of the first regulating body 51 can be easily switched from the accommodation posture PB2 to the standing posture PB1.

The protrusion 58 is formed on an edge portion of the upper end of the side end regulator 54. The protrusion 58 is a member that guides the paper sheet P2 when the paper sheet P2 is stored between the second regulators 50, and also inhibits the paper sheet P2 from passing over the first regulating body 51 at the time the position of the paper sheet P2 is regulated by the second regulators 50. The protrusion 58 extends in the third direction X3 (horizontal direction) with respect to the side end regulator 54 in the standing posture PB1, and inhibits the paper sheet P2 from passing over the first regulating body 51. Among the end portions of the protrusion 58, the end portion on the rear side with respect to the first direction X1 (the end portion on the front side with respect to the second direction X2) is upwardly inclined. Consequently, the paper sheet P2 is more easily inserted below the protrusion 58 at the time the paper sheet P2 is stored between the second regulators 50.

The protrusion 58 and the rear end regulator 56 protrude in the third direction X3 with respect to the side end regulator 54. Consequently, in order to prevent the protrusion 58 and the rear end regulator 56 from interfering with the accommodation portion 47 in the accommodation posture PB2, the accommodation portion 47 is formed having a protrusion slit 471 and a rear end regulator slit 472 that accommodate the protrusion 58 and the rear end regulator 56 (see FIG. 5).

The inclined portion 59 is formed to become lower toward the front with respect to the first direction X1. The inclined portion 59 is formed to inhibit the first regulating body 51 from protruding above the sheet feeding cassette body 11 in a state where the first regulating body 51 has been switched to the standing posture PB1 and the movable placement plate 40 has been switched to the sheet feeding posture PA1 (see FIG. 7B). Consequently, when the first regulating body 51 has been switched to the standing posture PB1, the inclined portion 59 is set to approximately the same height as the inclined portion 421 of the side wall portion 42 of the movable placement plate 40.

Figure 5:
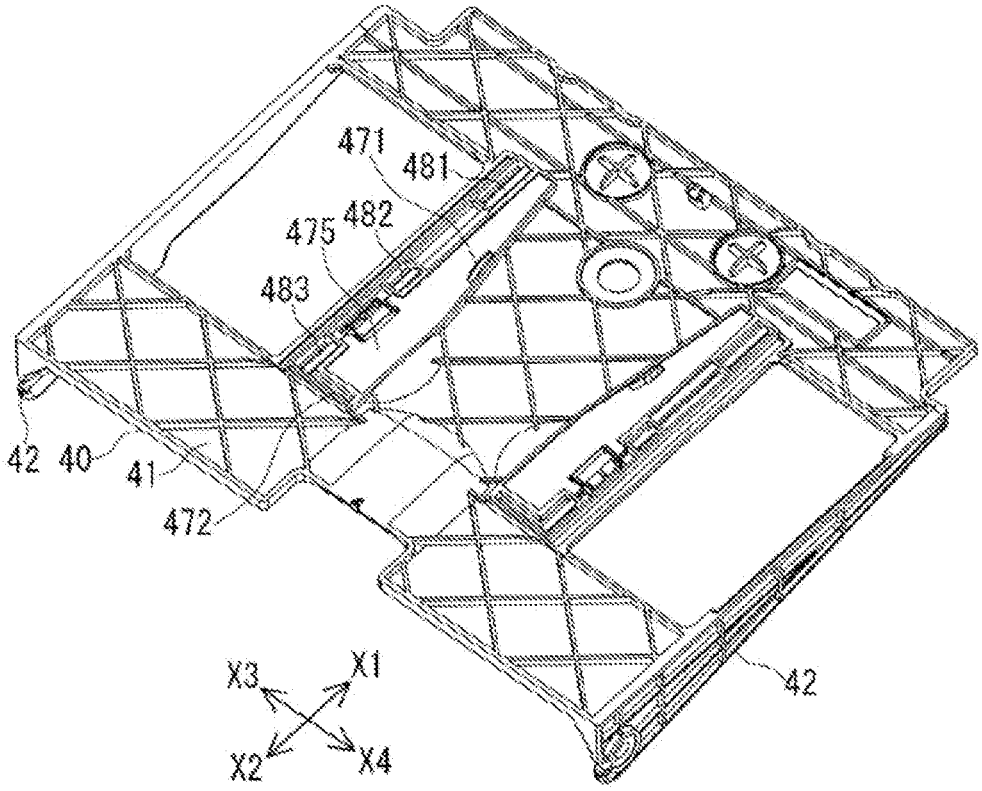
FIG. 5 is a perspective view showing a lower surface of the movable placement plate.

FIG. 5 is a perspective view showing the lower surface of the movable placement plate 40. In FIG. 5, an accommodation bottom portion 475, which is a lower surface of the accommodation portion 47, is visible. A protrusion slit 471 and a rear end regulator slit 472 are formed in the accommodation bottom portion 475. When the first regulating body 51 has been switched to the accommodation posture PB2, the protrusion 58 of the first regulating body 51 is accommodated in the protrusion slit 471 and the rear end regulator 56 of the first regulating body 51 is accommodated in the rear end regulator slit 472.

FIG. 6 is a perspective view of the first regulating body 51 that constitutes the second regulator 50. As shown in FIG. 6, a first holding portion 551, a second holding portion 552, and a third holding portion 553 are provided on a lower portion of the side end regulator 54 of the first regulating body 51. The first holding portion 551, the second holding portion 552, and the third holding portion 553 rotatably hold the first shaft 481, the second shaft 482, and the third shaft 483, respectively, which are each provided on a side portion of the accommodation portion 47. Among the respective end portions of the second holding portion 552 and the third holding portion 553, inclined surfaces 572 and 573 formed having a conical shape are formed on the end portions on the rear side with respect to the first direction X1 (the end portions on the front side with respect to the second direction X2). The inclined surfaces 572 and 573 inhibit interference such as the paper sheet P2 fed toward the first direction X1 becoming caught on the second holding portion 552 and the third holding portion 553.

Figure 7A:
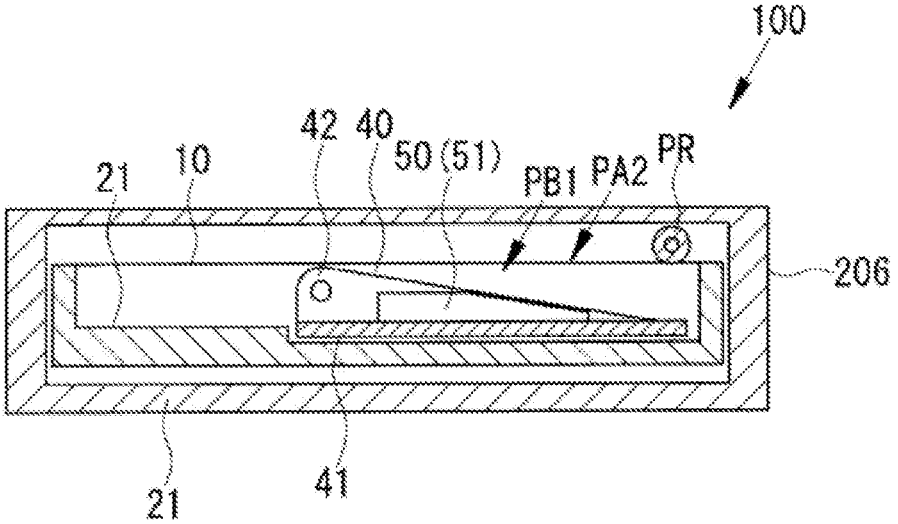
FIGS. 7A and 7B are cross-sectional views showing an operation of the movable placement plate, with the sheet feeding cassette cut at the position of line A-A in FIG. 2.
Figure 7B:
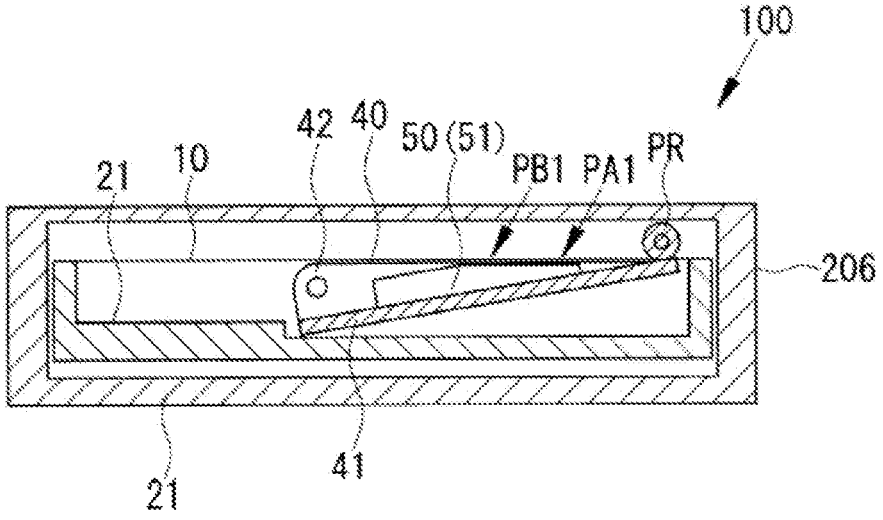
Figure 8A:
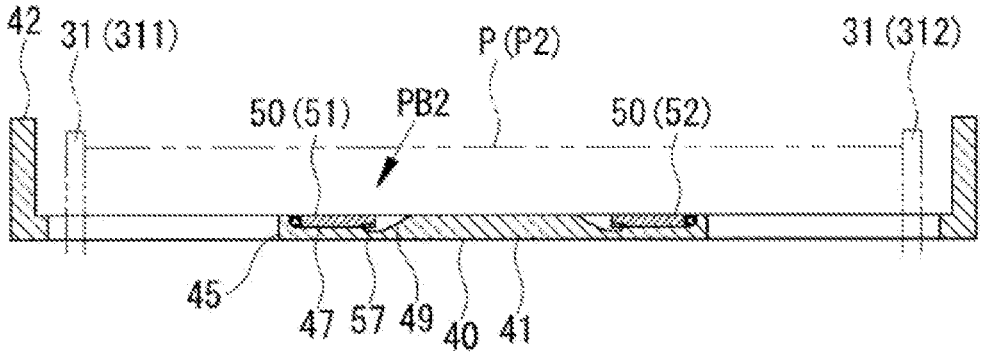
FIGS. 8A and 8B are cross-sectional views showing an operation of the second regulator, with the movable placement plate cut at the position of line B-B in FIG. 2.
Figure 8B:
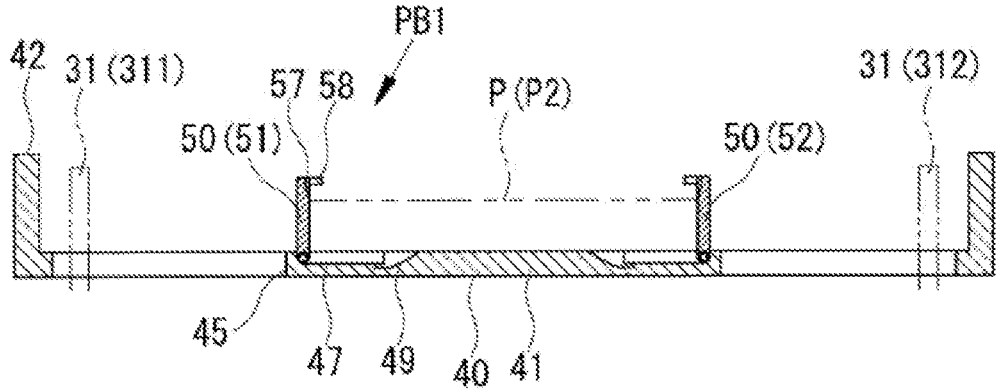

Next, an operation of the movable placement plate 40 and the second regulator 50 will be described with reference to FIGS. 7A and 7B and FIGS. 8A and 8B. FIGS. 7A and 7B are cross-sectional views showing an operation of the movable placement plate 40, with the sheet feeding cassette 10 cut at the position of line A-A in FIG. 2. FIGS. 8A and 8B are cross-sectional views showing an operation of the second regulator 50, with the movable placement plate 40 cut at the position of line B-B in FIG. 2. FIGS. 7A and 7B show states where the sheet feeding cassette 10 is mounted to the sheet feeding cassette mounting portion 206 of the image forming device body 201.

In FIG. 7A, the second regulator 50 has been switched to the standing posture PB1, and the movable placement plate 40 is switched to the non-sheet feeding posture PA2. In FIG. 7B, the second regulator 50 has been switched to the standing posture PB1, and the movable placement plate 40 is switched to the sheet feeding posture PA1.

In FIG. 8A, the second regulator 50 has been switched to the accommodation posture PB2. In FIG. 8B, the second regulator 50 has been switched to the standing posture PB1. As shown in FIG. 8A, in the accommodation posture PB2, the first regulating body 51 and the second regulating body 52 are accommodated in the accommodation portion 47. When the second regulator 50 has been switched to the accommodation posture PB2, it is possible for the paper sheet P1 to be stored using the first regulator 30. As shown in FIG. 8B, when the second regulator 50 has been switched to the standing posture PB1, it is possible for the paper sheet P2 to be stored using the second regulator 50.

According to the sheet feeding device 100 described above, the movable placement plate 40 is provided with the second regulator 50, and the second regulator 50 regulates the position of the paper sheet P2 having a different size to the size of the paper sheet P1 that can be regulated by the first regulator 30. Consequently, the paper sheet P can be stably supported by the movable placement plate 40, and various sheet sizes can also be supported without taking the trouble of attaching and detaching a separate member.

Second Embodiment

Next, a sheet feeding device 100A according to a second embodiment of the present invention will be described. In the sheet feeding device 100 according to the first embodiment, the side end regulator 54 and the rear end regulator 56 that constitute the first regulating body 51 and the second regulating body 52 of the second regulator 50 are integrally formed. However, in the paper sheet feeding apparatus 100A, a side end regulator 54A and a rear end regulator 56A that constitute a first regulating body 51A and a second regulating body 52A of a second regulator 50A are each separate members. In this case, the positions of the side end regulator 54A and the rear end regulator 56A can be individually set.

Third Embodiment

Next, a sheet feeding device 100B according to a third embodiment of the present invention will be described. In the sheet feeding device 100 according to the first embodiment, the positions of the first regulating body 51 and the second regulating body 52 that constitute the second regulator 50 are constant. However, in the sheet feeding device 100B, a first regulating body 51B and a second regulating body 52B that constitute a second regulator 50B have positions that can be adjusted according to a change in the size of the paper sheet P2. In this case, the second regulator 50B is capable of supporting various sheet sizes.

Other Embodiments

The embodiments disclosed here are exemplary in all respects, and is not a basis for a limited interpretation. Therefore, the technical scope of the present invention is not only interpreted by the above embodiments, but is also defined based on the scope of the claims. Furthermore, the technical scope of the present invention includes all modifications within the meaning and scope equivalent to the claims.

For example, the shapes of the first regulating body 51 and the second regulating body 52 that constitute the second regulator 50 are not limited by the above embodiments.

Furthermore, a paper sheet detector that detects which of the first regulator 30 and the second regulator 50 is being used to regulate the position of the paper sheet P (P1, P2), and a paper sheet size determinator that determines the size of the paper sheet P (P1, P2) based on a detection result of the paper sheet detector may also be provided. The paper sheet detector may be provided in the sheet feeding cassette 10, or may be provided in the sheet feeding cassette mounting portion 206. Furthermore, a detected portion may be provided in the second regulator 50 that determines whether or not the second regulator 50 is in use by detecting the position of the detected portion by means of the paper sheet detector. In this case, because the paper sheet size determinator determines the paper sheet size based on the detection result of the paper sheet detector, the paper sheet size can be easily determined.

INDUSTRIAL APPLICABILITY

The present invention can be applied to a sheet feeding device provided with a sheet feeding cassette, and an image forming device provided with a sheet feeding device.

What is claimed is:

1. A sheet feeding device comprising a sheet feeding cassette, which is detachable with respect to a sheet feeding cassette mounting portion provided on an image forming device body, wherein the sheet feeding cassette comprises:

a storage portion that stores at least one paper sheet;

a first regulator provided on a bottom portion of the storage portion and regulates a position of a paper sheet; and a movable placement plate that upwardly pushes a paper sheet stored in the storage portion, the movable placement plate comprises a second regulator that regulates a position of a paper sheet having a different size to a paper sheet size that is regulated by the first regulator, the movable placement plate, on which is placed a paper sheet whose position is regulated by the first regulator or the second regulator depending on a size, is configured to switch postures between a sheet feeding posture in which the paper sheet makes contact with a pickup roller and a non-sheet feeding posture in which the paper sheet is separated from the pickup roller, and the second regulator is configured to be accommodated in the movable placement plate, wherein a sheet feeding direction is a direction in which a paper sheet stored in the sheet feeding cassette R fed to the image forming device body, and the second regulator comprising:

a side end regulator that regulates a position of a side end portion, the side end portion being an end portion among end portions of a paper sheet stored in the storage portion which is parallel to the sheet feeding direction, and a rear end regulator that regulates a position of a rear end portion, the rear end portion being an end portion among the end portions of the paper sheet stored in the storage portion which is on a rear side with respect to the sheet feeding direction.

2. The sheet feeding device according to claim 1, wherein the movable placement plate further comprises an accommodation portion that stores the second regulator.

3. The sheet feeding device according to claim 1, wherein the side end regulator and the rear end regulator are integrally formed.

4. The sheet feeding device according to claim 1, wherein the second regulator has a position which is capable of being adjusted to correspond to a paper sheet size.

5. The sheet feeding device according to claim 1, further comprising:

a paper sheet detector that detects which of the first regulator and the second regulator is being used to regulate the position of a paper sheet; and a paper sheet size determinator that determines a paper sheet size based on a detection result of the paper sheet detector.

6. An image forming device comprising the sheet feeding device according to claim 1.

7. A sheet feeding device comprising a sheet feeding cassette, which is detachable with respect to a sheet feeding cassette mounting portion provided on an image forming device body, wherein the sheet feeding cassette comprises:

a storage portion that stores at least one paper sheet;

a first regulator provided on a bottom portion of the storage portion and regulates a position of a paper sheet; and a movable placement plate that upwardly pushes a paper sheet stored in the storage portion, the movable placement plate comprises a second regulator that regulates a position of a paper sheet having a different size to a paper sheet size that is regulated by the first regulator, the movable placement plate, on which is placed a paper sheet whose position is regulated by the first regulator or the second regulator depending on a size, is configured to switch postures between a sheet feeding posture in which the paper sheet makes contact with a pickup roller and a non-sheet feeding posture in which the paper sheet is separated from the pickup roller, and the second regulator is configured to switch postures between a standing posture, in which the second regulator stands upright with respect to an upper surface of the movable placement plate, and an accommodation posture, in which the second regulator is accommodated in the movable placement plate, wherein a sheet feeding direction is a direction in which a paper sheet stored in the sheet feeding cassette R fed to the image forming device body, and the second regulator comprising:

a side end regulator that regulates a position of a side end portion, the side end portion being an end portion among end portions of a paper sheet stored in the storage portion which is parallel to the sheet feeding direction, and a rear end regulator that regulates a position of a rear end portion, the rear end portion being an end portion among the end portions of the paper sheet stored in the storage portion which is on a rear side with respect to the sheet feeding direction.

* * * * *